United States Patent [19]

Marocco

[11] Patent Number: 5,010,940

[45] Date of Patent: Apr. 30, 1991

[54] SWINGABLE JUNCTION FOR A WINDOW COVERING

[76] Inventor: Norbert Marocco, 46 Pennygrass Court, Woodbridge, Ontario, Canada

[21] Appl. No.: 418,175

[22] Filed: Oct. 6, 1989

Related U.S. Application Data

[63] Continuation-in-part of Ser. No. 299,456, Jan. 23, 1989, abandoned, which is a continuation-in-part of Ser. No. 190,061, May 4, 1988, abandoned.

[51] Int. Cl.[5] ..... E06B 9/36

[52] U.S. Cl. ..... 160/168.1; 160/176.1; 160/178.1; 160/900; 403/119

[58] Field of Search ..... 160/114, 172, 196.1, 160/107, 88, 84.1, 262, 120, 166.1, 168.1, 176.1, 177, 178.1, 900, 241; 403/229, 161, 55, 402, 162, 163, 119; 16/262, 273, 364

[56] References Cited

U.S. PATENT DOCUMENTS

| | | | |
|---|---|---|---|
| 642,423 | 1/1900 | Brodie | 160/120 |
| 1,595,617 | 8/1926 | Raby | 403/229 X |
| 2,254,566 | 9/1941 | Cornell | 403/229 X |
| 2,605,824 | 8/1952 | Armstrong | 160/168 |
| 2,635,686 | 4/1953 | King | 160/172 |
| 2,679,778 | 6/1954 | Krafft | 403/229 X |
| 2,799,333 | 7/1957 | Baroni | 160/166 R X |
| 2,827,113 | 3/1958 | Graham | 160/172 |
| 3,157,223 | 11/1964 | Arena et al. | 160/168.1 |
| 3,190,346 | 6/1965 | Arena et al. | 160/172 |
| 3,280,891 | 10/1966 | Eldredge et al. | 160/172 |
| 3,389,738 | 6/1968 | Roth | 160/120 |
| 3,455,364 | 7/1969 | Fukuoka | 160/168.1 X |
| 3,500,896 | 3/1970 | Endou | 160/176.1 X |
| 3,570,577 | 3/1971 | Bedrin et al. | 160/193 X |
| 4,262,728 | 4/1981 | Debs | 160/172 X |
| 4,381,029 | 4/1983 | Ford et al. | 160/172 |
| 4,653,564 | 3/1987 | Marocco | 160/168.1 |
| 4,655,010 | 4/1987 | Arquati | 160/66 X |

FOREIGN PATENT DOCUMENTS

| | | | |
|---|---|---|---|
| 3104922 | 4/1982 | Fed. Rep. of Germany | 160/166 A |
| 1113641 | 5/1968 | United Kingdom | 160/107 |
| 1470533 | 4/1977 | United Kingdom | 160/166 A |

*Primary Examiner*—David M. Purol

[57] ABSTRACT

A corner junction assembly for use with two adjacent lengths of window covering track has a bearing ring making a captive frictional fit in a bearing hub to permit relative rotation of those two parts. The corner junction assembly is adapted to be connected to the ends of the adjacent lengths of the tracks. The corner junction assembly also facilitates the transmission of movement from a control such as a control cord or rod, in one of the lengths of track to a control in the other length of track.

35 Claims, 8 Drawing Sheets

SWINGABLE JUNCTION FOR A WINDOW COVERING

This application is a Continuation-in-Part of application Ser. No. 07/299,456, filed Jan. 23, 1989, Norbert Marocco, title SWINGABLE JUNCTION FOR BLIND TRACK, now abandoned, which was, in turn, a Continuation-In-Part of application Ser. No. 07/190,061, filed May 4, 1988, Norbert Marocco, title SWINGABLE JUNCTION FOR DRAPERY TRACK, and now abandoned.

The invention relates to a window covering apparatus as well as to corner junction assemblies for use in connecting two adjacent lengths of window covering track.

Window coverings such as vertical slat blinds are well known and comprise a track having a plurality of blind travellers movable therealong with slats suspended therefrom. The travellers can be drawn to and fro along the track, and the slats can be rotated so as to open or close the blinds.

Traveller operating means or control means and slat rotation control means extend along the track and hang downwardly from one end of the track.

The installation of two or more lengths of blind track, which meet at a corner, presents certain problems, particularly in the arrangements for the traveller and rotation control means.

One form of arrangement for such a corner junction assembly is described in U.S. Pat. Re. No. 33,216 dated May 15, 1990—Inventor Norbert Marocco, entitled Blind Assembly (U.S. Pat. Re. No. 4,653,564).

Using the system disclosed in the aforesaid patent, it is possible to join the two tracks at a corner and to provide for the traveller and rotation control means to extend around the corner. In this way, the control means, that is to say both the traveller moving means and also the blind slat rotation means, can be located at one end of one length of the track, and all of the blind travellers in both lengths of track can be operated simultaneously.

The system disclosed in the aforesaid patent has proved to be highly satisfactory in use, and has achieved considerable commercial success.

It is desirable to have a corner junction assembly which is capable of hinging or swinging, and then being set in a desired angle, so as to fit a particular window, or other installation.

One form of corner junction means is shown in the aforesaid patent. However, it incorporates several different components which must be assembled together during assembly of the blind and this may, in practice, require a certain amount of skill. In addition, the practice for assembling such blinds is to, first of all, assemble the lengths of track in the factory, and set them at the correct angle. The traveller operating means are then adjusted as to length so as to extend around the correct arc at each corner.

Once all of this has been done, the blind installation is then disassembled and shipped out. It must then be reassembled on the customer's premises.

In order to do this satisfactorily it is desirable to have a corner junction assembly which can be preset at a predetermined angle, so that when disassembled and then reassembled, it will go together in the correct fashion.

It is also desirable that the corner junction assembly shall be as short as possible. In blinds of this type, the blind slats are moved along the separate lengths of track in separate groups, although they are in fact moved simultaneously. When drawn fully to one side, the blind slats will hang, in groups, at the ends of their respective lengths of track. In order to avoid obstructing the ends of the tracks, it is thus desirable that the corner junction assemblies at the ends of the tracks shall be as short as possible.

The invention is also applicable to other forms of window covering such as venetian blinds, "Russian" drapes, and "Balloon" drapes and any other window coverings which incorporate some form of head rail or track as a support, and controls in the head rail.

In all of these cases, it may be desirable to install such window coverings around corners for example in bay windows and the like, and in that case, by the use of the invention, the head rails or supporting devices of the window coverings may be connected together, and the controls for the operation of the window coverings may thus be located at one end of one of the head rails or supports.

For the purposes of this description, the term "rail" is intended to include any horizontal support for a window covering whether it be a track as used in vertical blinds or a head rail as used in venetian blinds, or any other form of support.

SUMMARY OF THE INVENTION

With a view to overcoming the various problems listed above, the invention comprises a corner junction assembly for use in association with two adjacent window covering rails, such rails each being adapted to carry window coverings and each having at least one movable control means, the corner junction assembly comprising at least one bearing ring means; at least one bearing hub means making a captive frictional fit within the bearing ring means to permit relative rotation thereof; and track engagement means connected to respective ones of the bearing ring means and the bearing hub means for engagement with adjacent ends of respective ones of the rails.

Usefully, a corner junction assembly in accordance with this invention comprises upper and lower bearing ring means and upper and lower bearing hub means, the upper bearing hub means making a captive frictional fit within the upper bearing ring means and the lower bearing hub means making a captive frictional fit within the lower bearing ring means, and the upper and lower bearing ring means being spaced apart.

Such a corner junction assembly is usefully provided with an opening in one of the upper and lower bearing hub means and a removable closure means is provided for closing the opening. Such a closure means is usefully formed with a snap ring making a captive snap fit within such opening.

In accordance with a particularly preferred feature of this invention, a corner junction assembly in accordance therewith includes a downwardly dependent arcuate cup member formed integrally with the upper bearing hub means, and a bearing surface of corresponding shape is formed on the upper bearing ring means to guidingly engage the exterior of the cup member.

Such a cup member is usefully formed with a plurality of fracture lines parallel to one another at spaced intervals therearound, whereby portions of the cup member may be broken away during installation of the corner junction assembly with the blind tracks to accommodate different angular positions of those blind tracks.

Usefully, in such a corner junction assembly, the lower bearing ring means is formed separately from the upper bearing ring means and is secured thereto for conjoint rotational movement therewith and the lower bearing hub means is formed separately from the upper bearing hub means and is secured thereto for conjoint rotational movement therewith.

The bearing hub means of a corner junction assembly in accordance with this invention is usefully formed with a locking ring making a captive pressure fit within the bearing ring means.

The track engagement means provided in a corner junction assembly in accordance with this invention usefully comprise block members formed on the bearing ring means and the bearing hub means and adapted to fit into ends of the adjacent rails.

In one embodiment of a corner junction assembly according to the invention, the moveable control means comprises at least one length of control cord in each of the rails and connected to run through the corner and at least one pulley for guiding such control cord. In one particular embodiment, such pulley or pulleys are mounted externally on the corner junction assembly.

Another embodiment of a corner junction assembly according to the invention is intended for use with rails in which the control means are control rods rotationally mounted, and in such an embodiment movement transmission means are provided in the corner being adapted to transmit rotational movement between the control means of the two rails. Such a rotatable movement transmission means can comprise a flexible coupling and at least one bearing means supporting the flexible coupling.

Usefully, such a flexible coupling is adapted to be connected to the control means for conjoint rotation therewith but in such a manner that axial movement of the flexible coupling relative to at least one of the traveller control means is possible to accommodate different angular positions of the rails.

In another embodiment, such rotatably mounted movement transmission means comprises interengaged gear means adapted to be secured to ends of the traveller control means of the rails for conjoint rotation therewith. In one embodiment, such gear means are adapted to be secured to the ends of the traveller control means for conjoint rotation therewith while permitting axial movement of the gears means relative to at least one of the traveller control means to accommodate different angular positions of the rails.

Spring means are usefully provided to maintain such gear means in engagement with each other at varying angular positions of the rails. If, however, such gear means are disposed for rotational movement through a rotational axial position of the corner junction assembly, then there is no need for relative axial movement of the gear means and the traveller control means during movement of the rails into different angular positions.

In another particular embodiment, each of the rails comprises two such rotationally mounted control means, namely first control means for rotating the angular positions of travellers in the tracks and second control means for moving the travellers along the rails. In such an embodiment, there is provided in the corner junction assembly, both a first movement transmission means adapted to transmit rotational movement between the first traveller control means and a second movement transmission means, adapted to transmit rotational movement between the second traveller control means. Such first and second movement transmission means can both comprise flexible couplings supported by respective bearing means.

Alternatively, one of the first and second movement transmission means can comprise a flexible coupling supported by a bearing means and the other of the first and second movement transmission means can comprise interengaged gear means.

The present invention also embraces a blind apparatus adapted to be installed around at least one corner and comprising at least two lengths of rail meeting at such a corner; groups of travellers on each length of rail, adapted to slide therealong, and adapted to support blind slats thereon; first traveller control means connected with the travellers in each length of rail for moving the travellers along the lengths of rail; second traveller control means connected with the travellers in each length of rail for rotating the blind slats relative to the lengths of rail; and a corner junction assembly at such corner, such corner junction assembly in turn comprising at least one bearing ring means; at least one bearing hub means making a captive frictional fit with the bearing ring means to permit relative rotation thereof; engagement means connected to respective ones of the bearing ring means and the bearing hub means and engaging adjacent ends of respective ones of the lengths of rail at such corner; a first movement transmission means coupled to the first traveller control means in each length of rail to transmit movement therebetween; and a second movement transmission means coupled to the second traveller control means in each length of rail to transmit movement therebetween;

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

The invention will now be described merely by way of illustration with reference to the accompanying drawings in which.

DESCRIPTION OF THE PREFERRED EMBODIMENTS

Figure 1:
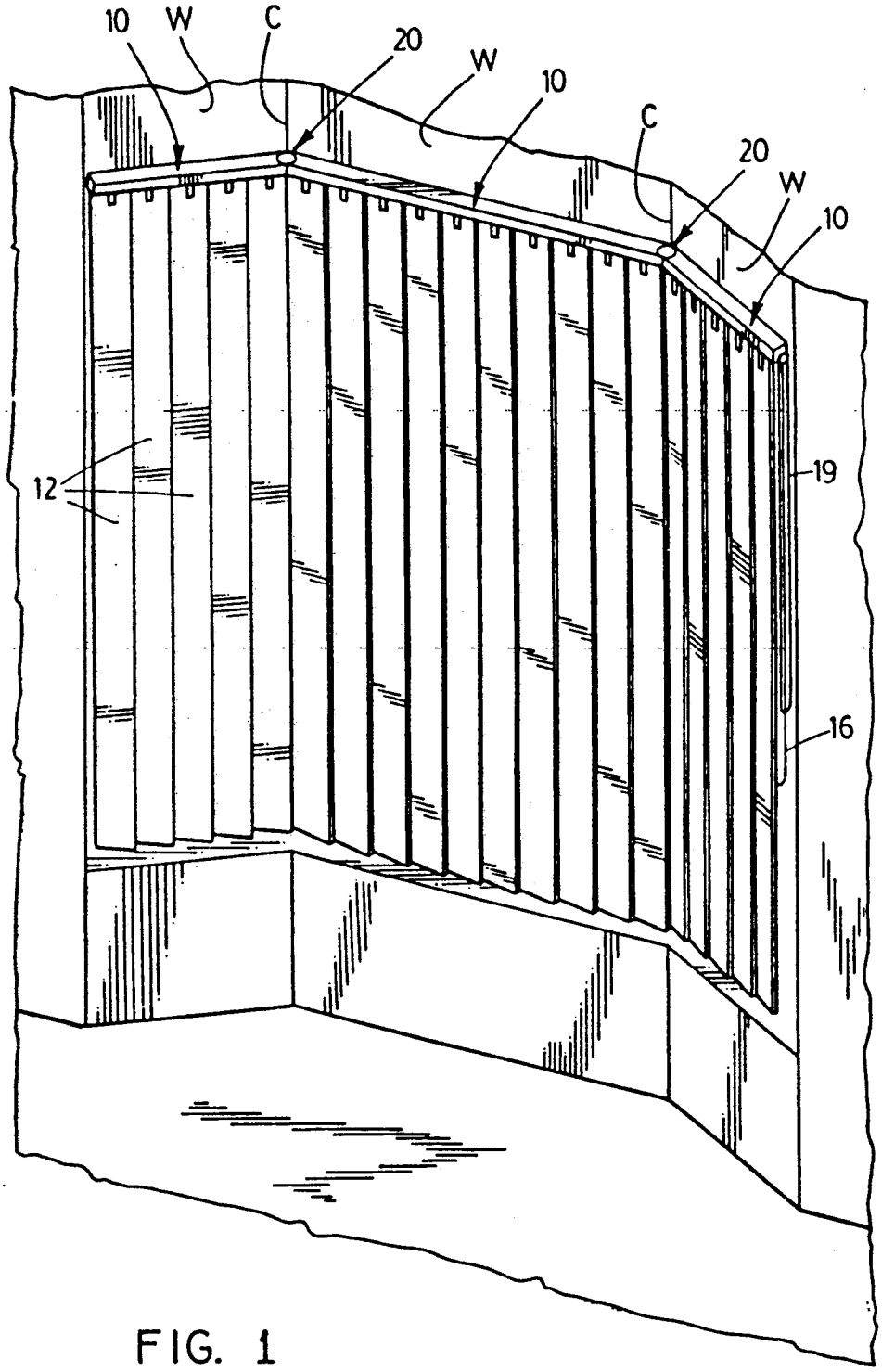
FIG. 1 is a general perspective illustration of one embodiment of a blind installation or apparatus in accordance with this invention, and shown as extending along three walls which meet at two corners.

Referring first of all to FIG. 1, it will be seen that the invention is illustrated therein as a vertical slat blind installation mounted in a situation in which there are three wall surfaces indicated generally as W, meeting at two corners indicated generally as C.

Typically, this represents a bay window installation. However, blinds may be used in bay windows, or may be used to cover other openings or other surfaces, and the invention is not to be taken as exclusively limited to use in association with bay windows or, in fact, windows of any kind.

As explained above, while the invention is illustrated here in use in association with a vertical blind installation, it will be understood that the invention is not restricted thereto, but comprehends applications to any form of window covering wherein a support, e.g., a rail, contains controls for the window covering, and it is desired to install two or more supports or rails around a corner, and to provide for operation of the window coverings from only one end of one of the rails.

A plurality, in this case, three, lengths of blind rails or tracks generally indicated at 10, are shown mounted on the walls W, with the three lengths of track 10 meeting at the two corners C.

From the tracks 10 a plurality of slats 12 hang downwardly from the travellers 14.

Traveller control means are provided which, in this embodiment of the invention, are indicated as the control or pull cord 16 and the control rod 18. The cord 16 hangs downwardly at one end of one of the tracks 10 and is operative to move the slats 12 along the tracks 10. The control cords 16 are used to draw the travellers to and fro along the tracks in well known manner. The control rod 18 is rotatable by movement of, e.g., a control chain 19, to adjust the angular position of the slats 12 relative to the tracks 10. The hanging portion of the cord 16 and the control chain 19 are shown in a horizontal position in FIG. 2 to clarify their functions.

It will be appreciated that the showing of a control cord 16 and a control rod 18 are merely illustrative of the traveller control means in general. Various different designs of traveller control means are possible and the invention is not intended to be restricted to any particular form of traveller control means.

The tracks 10 and slats 12 may be of entirely conventional construction, such as are well known in the art and are made by a number of different manufacturers and are not, therefore, described in any detail, for the sake of clarity.

As shown generally in FIG. 1, the three lengths of blind track 10 are connected at the two corners C by means of corner junction assemblies in accordance with this invention and as indicated generally at 20.

Figure 4:
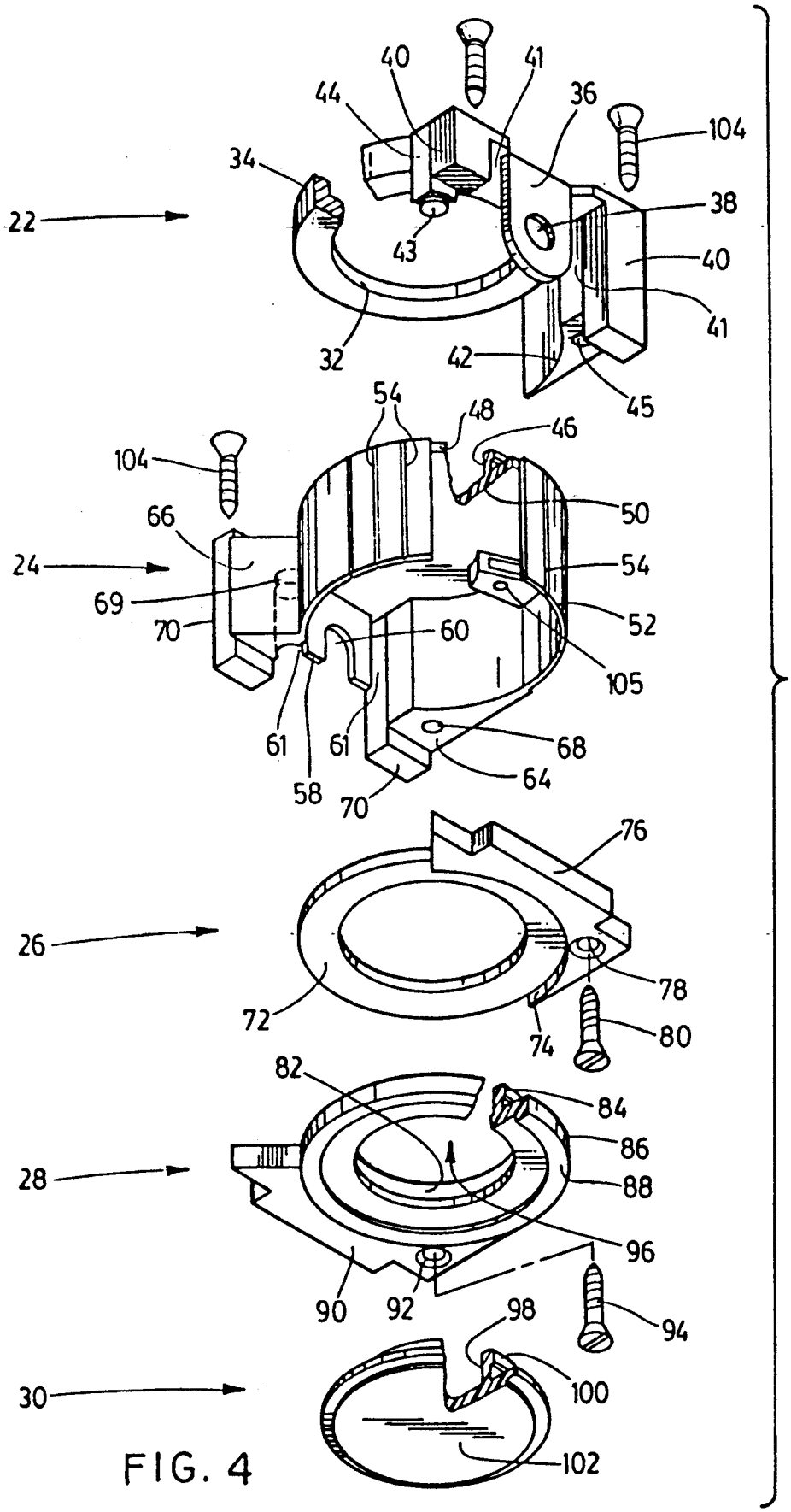
FIG. 4 is an exploded perspective illustration of the corner junction assembly shown in FIGS. 1 to 3.

Referring now to FIG. 4, the corner junction assembly 20 in accordance with the invention will be seen to comprise five separate moulded components, namely an upper bearing ring member or means 22, an upper bearing hub member or means 24, a lower bearing ring member or means 26, a lower bearing hub member or means 28, and a closure means or plate 30, provided for the sake of appearance.

Upper bearing ring member 22 comprises a generally annular bearing means 32, and an upstanding annular wall 34, forming an L-shaped structure in section.

Along one side of the junction between the bearing means 32 and the wall 34, there is formed a downwardly dependent end plate 36, with a guidance opening or bearing 38 formed therethrough.

A pair of generally rectangular track engagement means or mounting block members 40 are also integrally formed with the upper bearing ring member 22 and extend more or less normal thereto on either side of the plate 36 to define openings 41 on either side thereof.

A bearing surface or arcuate guidance cuff 42 is formed integrally with one of block members 40 and the annular bearing means 32. A guidance pulley 43 is mounted on a guidance wedge portion 44 formed integrally with the other of blocks 40. A screw receiving recess 45 is formed in cuff 42.

The upper bearing hub member 24 comprises an annular bearing hub 46, having an upper free edge terminating in a locking ring 48. Hub 46 and ring 48 are intended to make a snap fit through the bearing means 32, and to be rotatable therein.

A flat disc-like plate 50 is formed integrally with the lower edge of the bearing hub 46. A generally partially cylindrically shaped downwardly dependent wall or cup member 52 extends downwardly from the perimeter of plate 50, thus forming what may be called an inverted cup-shaped structure.

Fracture or break lines 54 (shown in FIG. 4 but omitted from FIG. 3) are provided in the wall 52 for a purpose yet to be described.

A downwardly-dependent planar flange 58, having a guidance opening or bearing means 60, is provided on plate 50 and has openings 61 on both sides for a reason yet to be described.

Two generally wedge-shaped block portions 64 and 66 are formed on the exterior of the generally cylindrical wall 52. A screw-receiving recess 68 is usefully formed in the block portion 64 for a reason yet to be described.

A guidance pulley 69 is mounted on block portion 66.

Track engagement means or mounting block members 70 are formed on respective blocks 64 and 66, for engagement with one of the blind tracks 10.

The lower bearing ring member 26 comprises an annular bearing ring 72, with an arcuate guidance cuff 74 formed therearound. An attachment flange 76 extends from the guidance cuff 74, and is provided with a screw hole opening 78.

A screw 80 passes through opening 78 and is received in screw receiving recess 45 in cuff 42 of upper bearing ring member 22.

The lower bearing hub member 28 comprises a bearing hub ring 82, having at its upper free edge a locking ring 84. Rings 82 and 84 make a snap fit within bearing ring 72 of bearing ring member 26, and are rotatable relative to one another. A generally outward-extending bearing flange 86 is formed around the lower edge of hub ring 82, and extends outwardly substantially normal thereto defining a generally L-shape in section. A downwardly-dependent annular wall 88 extends around the exterior of the flange 86.

A mounting flange 90 is provided along one edge of flange 86, and has a screw receiving opening 92 for screw 94.

Screw 94 is intended to be received in recess 68 in block portion 64 of upper bearing hub member 24.

The flange 86 also defines a central opening 96 therethrough. In order to close this opening the closure plate 30 comprises a fastening sleeve 98, with a locking ring 100 adapted to make a snap fit within opening 96. A generally flat disc-like plate 102 is moulded to the bottom edge of the sleeve 98.

Screws indicated as 104 may be fastened through suitable holes drilled in the end portions of tracks 10, and such screws will then be received in screw recesses (not shown) formed in the respective block members 40 and 70.

Figure 5:
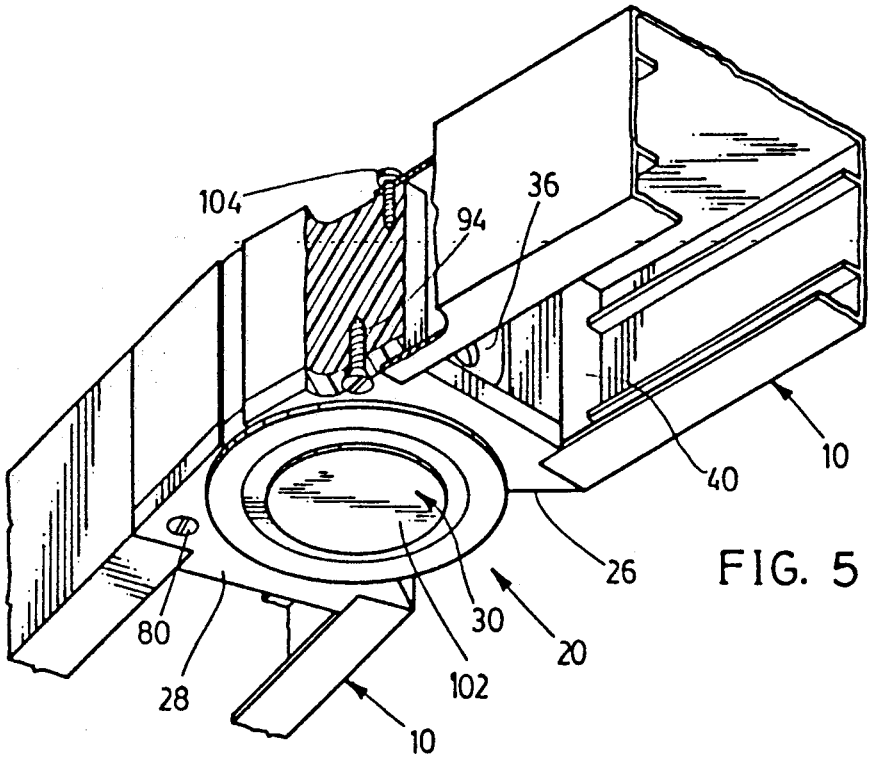
FIG. 5 is a cut-away perspective view of the same corner junction assembly with certain parts omitted.

In this way, the corner junction assembly can be connected between two adjacent lengths of track 10 as shown in FIG. 5, and the two lengths of track are then rendered swingable relative to one another, within the limits of the are defined by the construction of the corner junction member.

Figure 3:
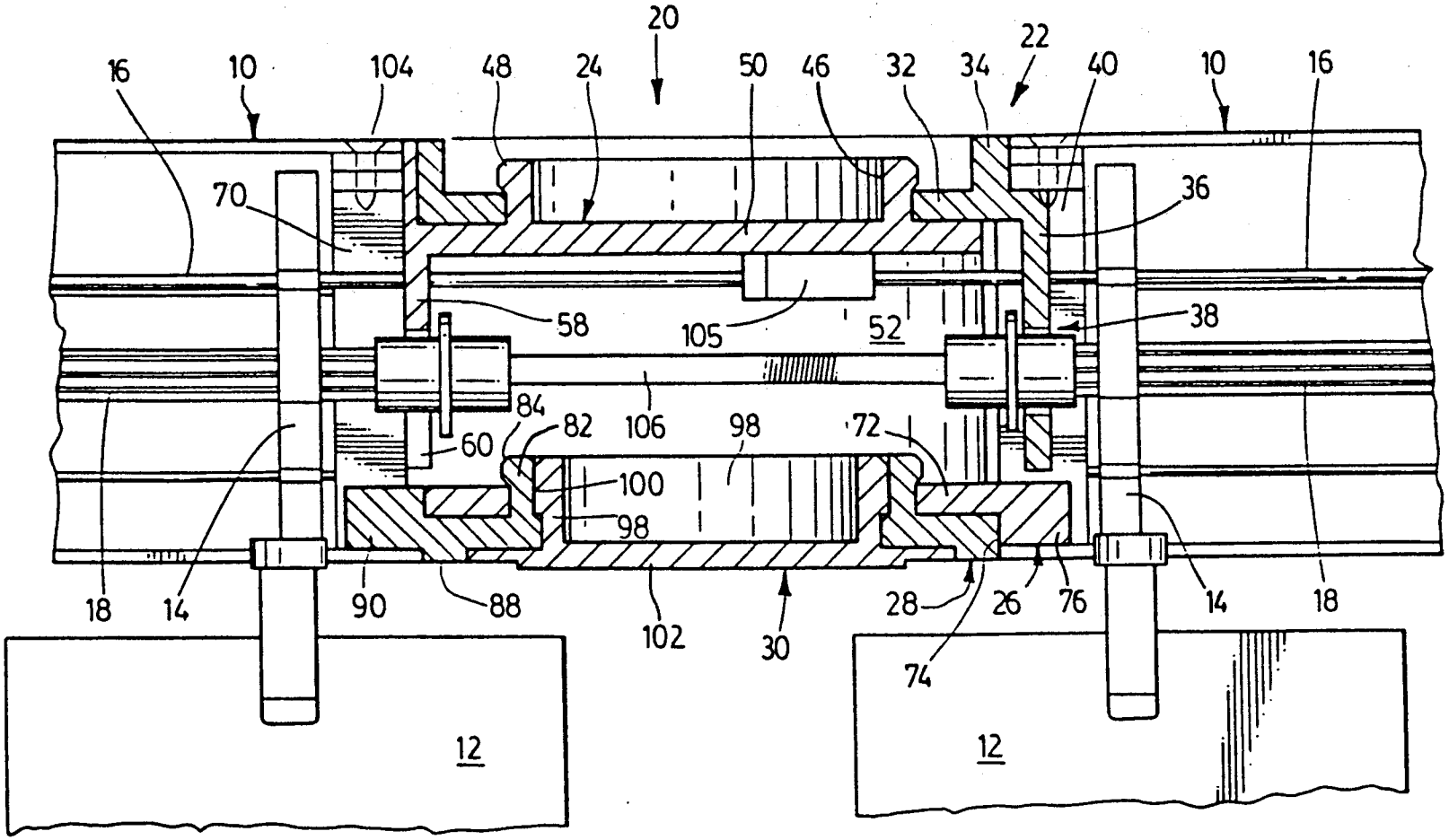
FIG. 3 is a sectional view when taken as indicated by the arrows 3—3 of FIG. 2.

As is also shown in FIG. 3, the traveller control means, namely the control cords 16 and the control rods 18, extend through respective openings in the wall or cup member 52. Pull cords 16 are guided around the corner, by pulleys 43 and 69, and by a further pulley 105 mounted in the interior of the wall 52, typically by being fastened to the underside of the plate 50.

The control cords 16 run through the spaces on opposite sides of plate 36 and flange 58. Portions of wall 52 may be broken away, along lines 54, to allow free passage of the pull cords through the corner assembly 20.

Lead traveller engagement means such as buttons 107 are provided on cords 16, or frictional stop means (not shown) as described in U.S. Pat. No. 4,653,564, and require no further description.

The travellers are arranged in groups, consisting of a lead traveller, connected to the traveller control means such as cords 16, and associated travellers connected to the lead traveller. All of this is described in the aforesaid U.S. patent.

The control rods 18 may be coupled by means of a movement transmission means or flexible coupling 106, described below.

Figure 6:
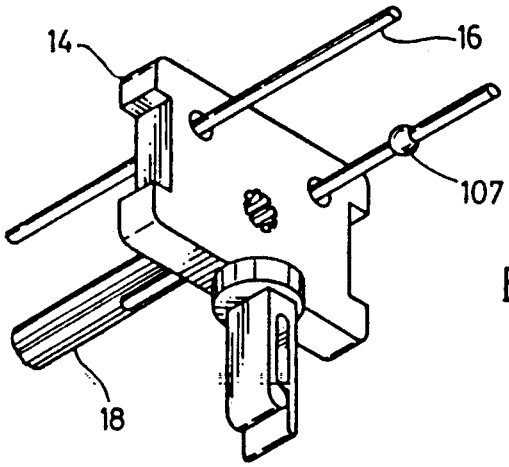
FIG. 6 is a schematic perspective view of one embodiment of a traveller and traveller control means used in the blind installation shown in the preceding figures.

A typical traveller 14 used in this type of blind is shown in FIG. 6.

Figure 7:
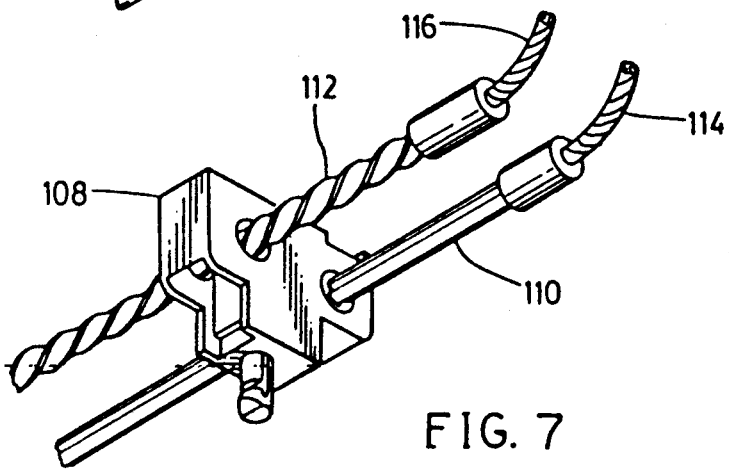
FIG. 7 is a schematic perspective view of a second embodiment of a traveller and control means which can be used in a blind installation in accordance with this invention.

Alternatively, however, the invention is equally applicable to blinds in which a modified form of traveller 108, as shown in FIG. 7, is used. In this form of traveller a control rod 110 is provided, for a similar purpose to the control rod 18 in the traveller 14; that is to say, the control rod 110 rotates the slats, as does the control rod 18 in the embodiment of FIG. 6.

However, the traveller 108 differs from the traveller 14 in that the pull cords 16 are replaced by a continuous screw rod 112. The interior of the traveller is so constructed that by the rotation of the screw rod 112 the travellers are caused to move to and fro along the track.

The details of such travellers are well known to persons skilled in the art and require no further description.

In this form of the invention, two flexible couplings 114 and 116 would be provided in each corner: one joining two control rods 110 and, one joining two screw rods 112. The two flexible couplings may be similar to the single flexible coupling 106 shown in FIGS. 2, 3 and 8.

Figure 8:
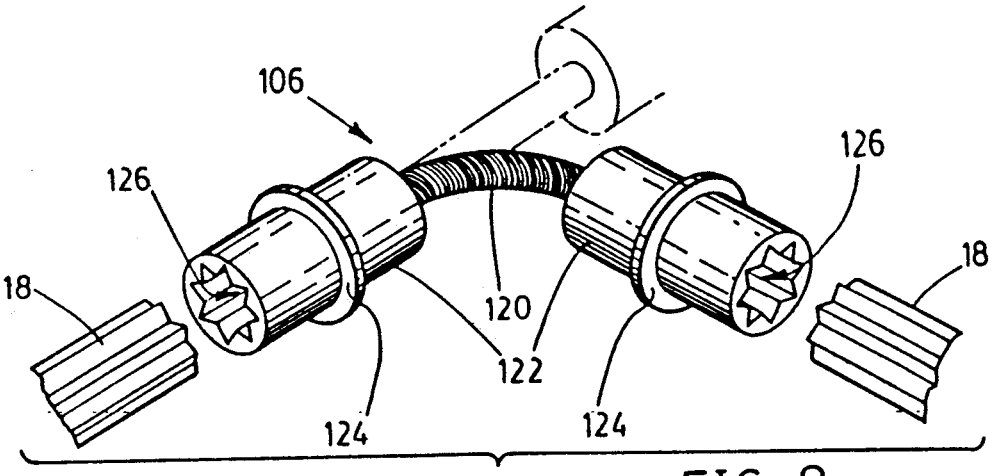
FIG. 8 is a perspective exploded illustration of a flexible coupling for use in a corner junction assembly in accordance with this invention.

The flexible coupling 106 is shown in more detail in FIG. 8, from which it will be seen to comprise a length of helical wound spring wire 120, the two ends of which are embedded in identical coupling members or drive hubs 122 which are relatively elongated and which fit, with a certain degree of clearance, within openings or bearing means 38 and 60 of the corner ring member 22 and the bearing hub member 24 respectively (see FIG. 3).

Collars 124 are formed on hubs 122 and act as thrust plates, so as to ensure that the hubs 122 remain in the correct position, and rotate freely.

The free ends of hubs 122 are provided with recesses 126 formed with suitable surfaces, or splines to receive and engage adjacent ends of the two control rods 18.

The spring portion 120 is flexible (as shown in phantom) and will normally be straight, and can be flexed to fit around the desired angle to which the corner junction assembly 20 is set.

Figure 9:
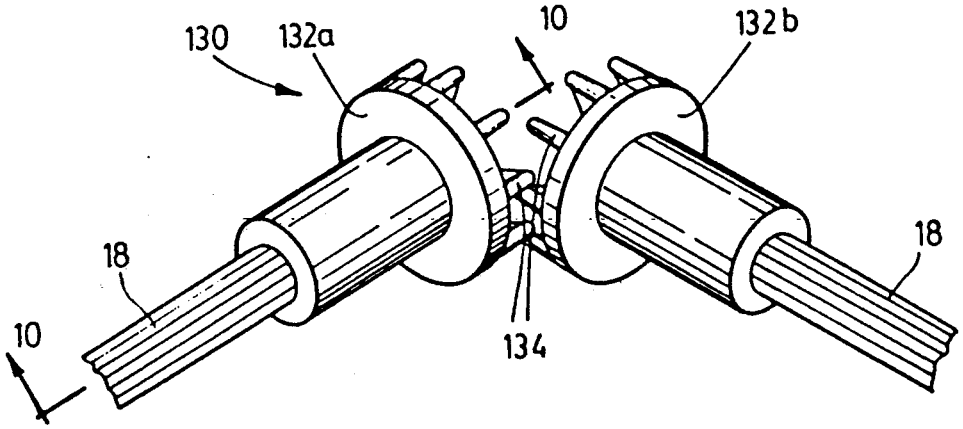
FIG. 9 is a perspective illustration of an alternative form of coupling for use in this invention.
Figure 10:
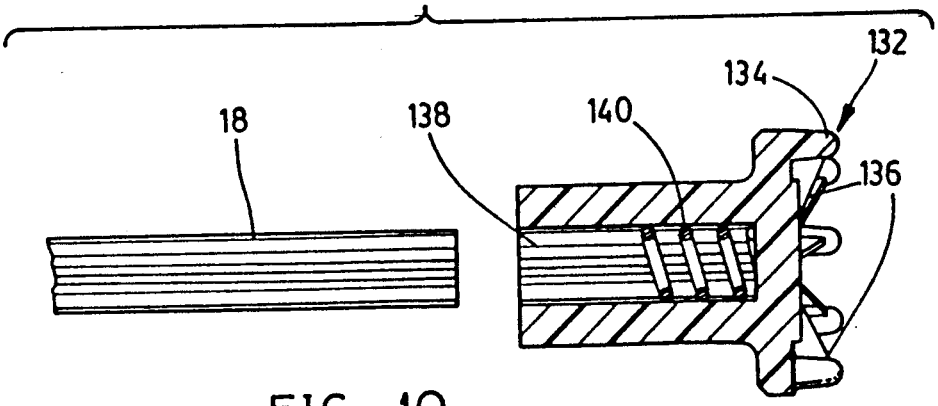
FIG. 10 is an exploded sectional view when taken as indicated by the arrows 10—10 of FIG. 9.

An alternative form of movement transmission means is shown in FIGS. 9 and 10.

As shown in FIG. 9, is a movement transmission means indicated generally as 130 which comprises two crown gear wheels **132*a*, 132*b* each having identical teeth 134 formed thereon. The teeth 134 are formed essentially as pins or rods, with reinforcing web portions 136 (FIG. 10) extending therefrom at an angle. Both crown wheels 132 are formed with a recess 138 adapted to receive and engage the end of the respective control rod 18. Within each recess 138, there is provided a spring 140**.

The effect of the two springs 140 is to urge the two gear wheels **132*a* and 132*b*** into engagement with one another at the various different angles to which the corner assembly may be set.

Figure 2:
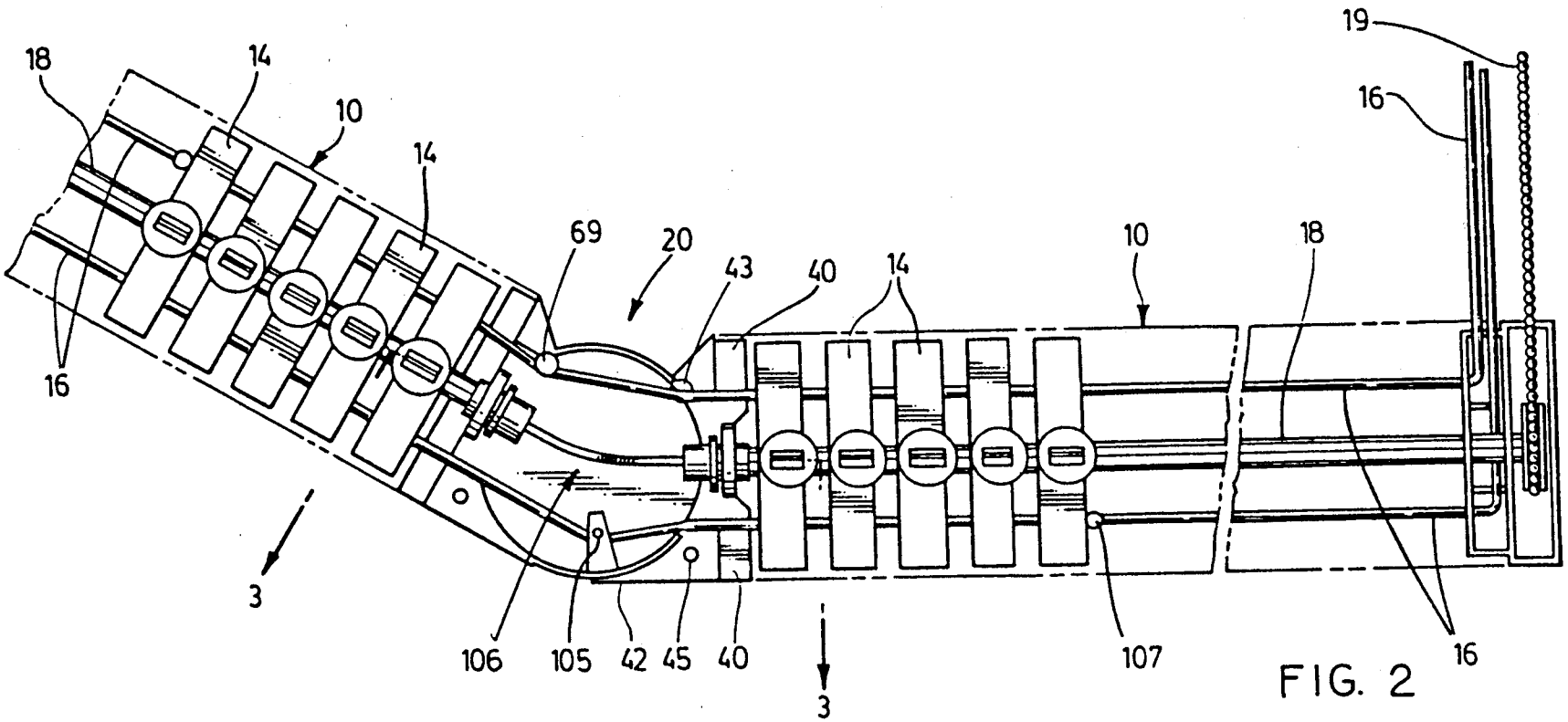
FIG. 2 is a bottom plan view, looking upwardly of one embodiment of a corner junction assembly as used in the blind assembly as shown in FIG. 1 and with certain parts omitted to reveal its internal construction.

In the embodiment of FIGS. 1, 2 and 3, the track 10 is shown in which the travellers and all of the moving parts are contained inside the tracks.

However, there are certain manufacturers who manufacture tracks in which some of the controls are arranged exteriorly of the track.

Figure 11:
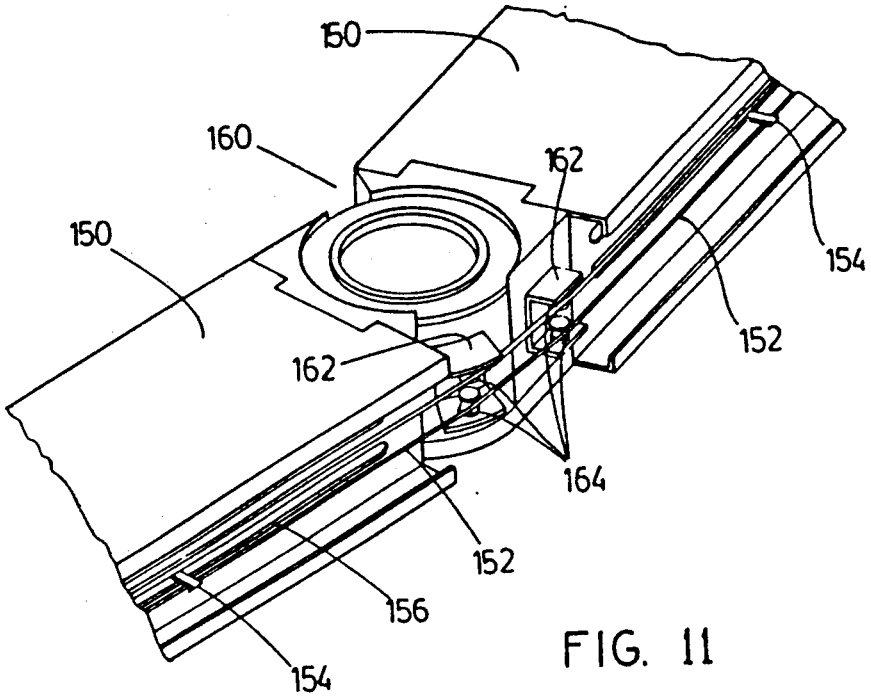
FIG. 11 is a rear perspective illustration of an alternative embodiment of a corner junction assembly in accordance with this invention.

One such form of track is shown in FIG. 11 as 150.

In this case, the travellers, (not shown) are located within the tracks in essentially the same way as is shown in FIG. 2. In addition, control rods (not shown) are arranged within the tracks.

In the form of track shown in FIG. 11, however, the manufacturer has chosen to provide flexible control elements 152 which are located externally on the concealed or rearward side of the tracks 150. The control elements 152 are attached to traveller brackets 154 connecting with the lead travellers in each group.

The traveller brackets 154 extend through slots 156.

In the case of this form of track, the present invention provides a modified form of corner assembly indicated generally as 160.

The corner junction assembly 160 is made substantially as shown in FIGS. 3 and 4, but without the interior pulleys for guiding the flexible elements.

Instead, exterior pulley mounting brackets 162 are provided on the rearward or concealed side of the corner 160, having pulleys 164 mounted thereon.

Two pulleys are provided for each of the flexible elements making a total of four in all.

The two pulley mounting brackets 162 are attached to the corner assembly 160 in such a way that when the corner assembly is swung to a desired angular position, the pulley mounting brackets 162 will also swing apart from one another. Thus the pulleys 164 will remain in engagement with the flexible elements at all times.

Figure 12:
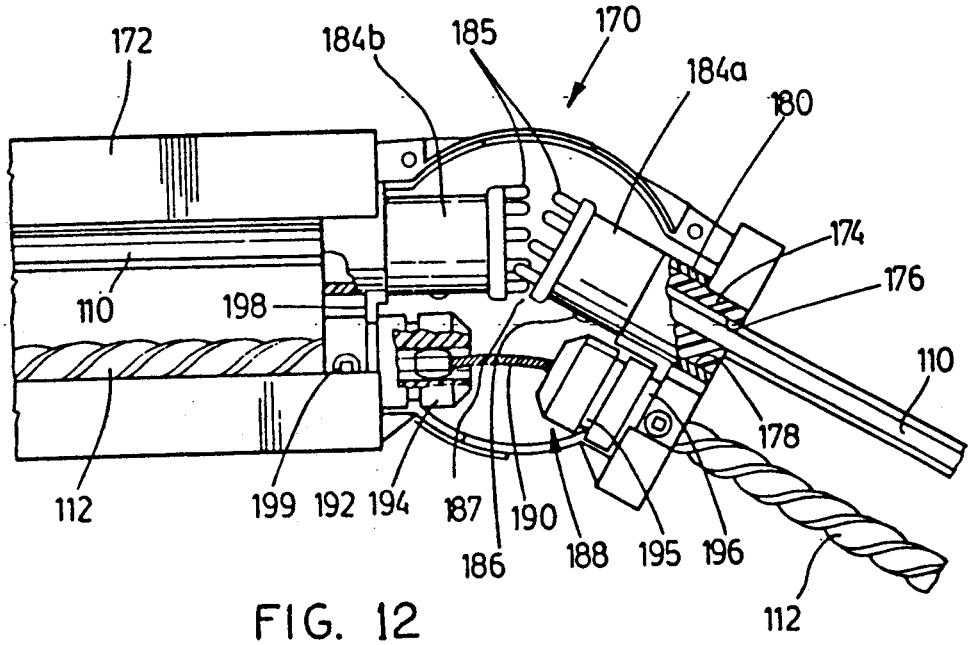
FIG. 12 is a sectional view through another embodiment of a corner junction assembly in accordance with this invention.

Reference will now be made to FIG. 12 in which there is indicated generally at 170 a corner junction assembly for use with tracks 172 housing control rods 110 for changing the rotational position of the slats and screw rods 112 for moving the slats along the tracks.

Rotational movement is transferred in the corner junction assembly 170 between the control rods 110 in essentially the same manner as already described with reference to the embodiment shown in FIGS. 9 and 10.

In the embodiment shown in FIG. 12, the control rods 110 pass through inner bearing members 174 having splined axial bores 176 receiving the control rods 110 for co-rotation therewith. The inner bearing members 174 are rotatably received within bores 178 formed in fixed mounting sleeves 180. The ends of the control rods 110 are secured in openings in crown gear wheels **184*a* and 184*b* having teeth 185 by set screws 186. It has been found that, by disposing the drive transfer members so that the teeth 134 rotate through a position which lies essentially on the rotational axis 187 of the corner junction assembly 170, the need for relative axial movement of the control rods 110 and the crown gear wheels 184*a* and 184*b* is elminated. Consequently, in this particular embodiment, there is no need for the compression springs 140 as shown in FIG. 10**.

Similarly, rotational movement is transferred in the corner junction assembly 170 between the screw rods 112 in essentially the same manner as already described with reference to FIG. 8 using a flexible coupling indicated generally at 188. From FIG. 12, it will be seen that the flexible coupling 188 comprises a length of helically wound spring wire 190, the ends of which are anchored in couplings 192 which are, in turn, mounted for limited axial movement in bores in drive hubs 194. The couplings 192 and the bores in the drive hubs 194 have corresponding non-circular cross-sectional shapes, for example, hexagonal, to ensure conjoint rotation of the couplings 192 and the drive hubs 194.

The drive hubs 194 are provided with axially spaced apart annular grooves 195 and 196 which receive corresponding ribs 198 provided on the corner junction assembly 170 to permit free rotation of the hubs 194.

In adjusting the angular position of the tracks 172, the couplings 192 move within the drive hubs 194. In the event that it is desired to position the tracks 172 at a relatively small angle, the drive hubs can be moved within the corner junction assembly 170 so that the ribs 198 are disposed within the recesses 195 rather than the recesses 196 as actually shown in FIG. 12. This is effective to separate the drive hubs 194 a sufficient distance to permit the required separation of the couplings 192.

The drive hubs 194 are secured to the screw rods 112 by set screws 199.

Figure 13:
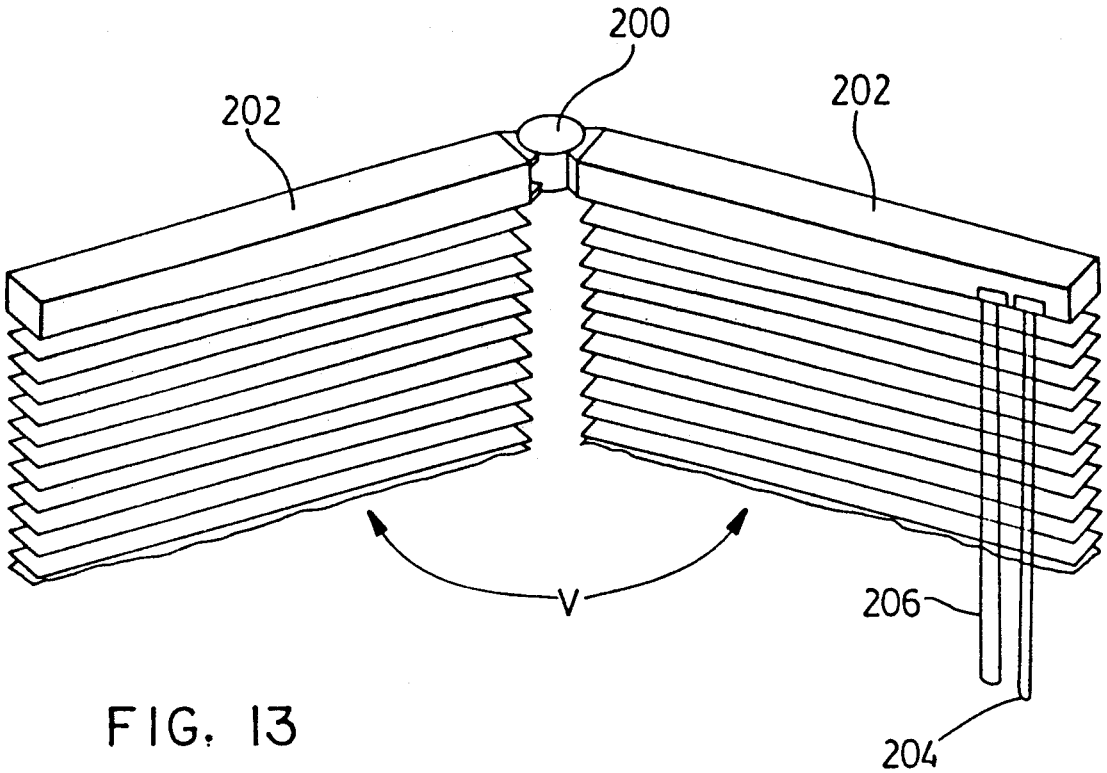
FIG. 13 is a fragmentary perspective illustration of the joining of two venetian blind rails.
Figure 14:
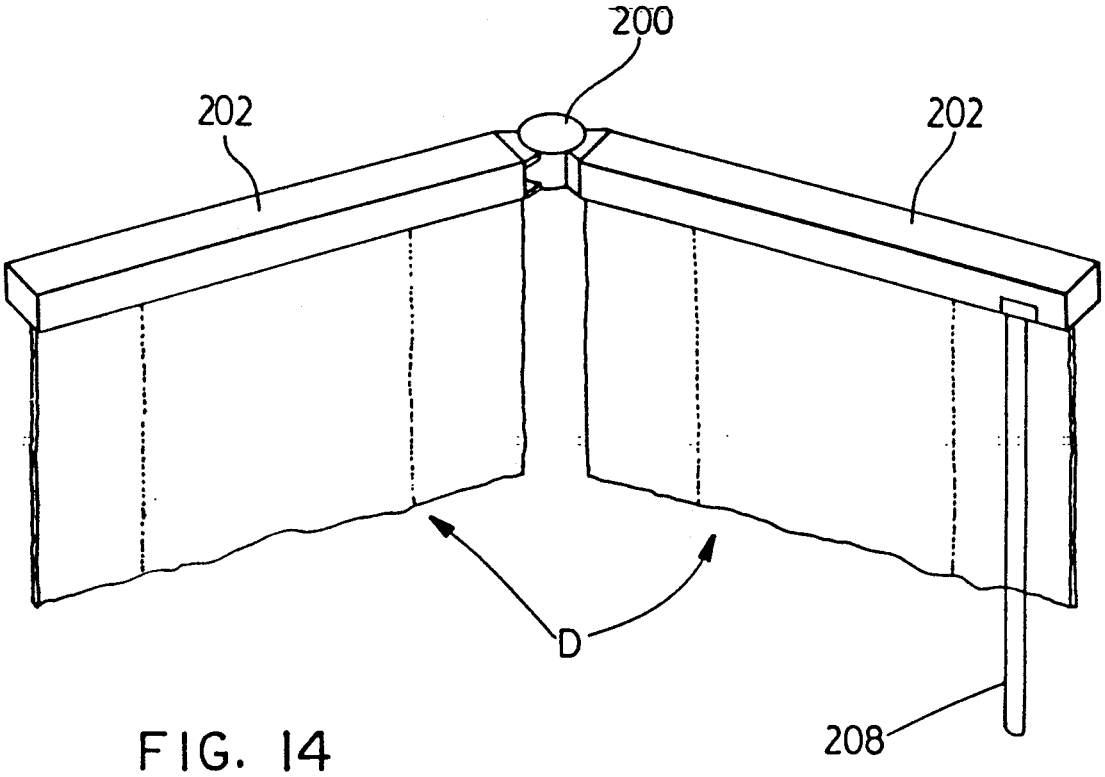
FIG. 14 is a fragmentary perspective illustration of the joining of two rails for other forms of window covering.

As shown in general, in FIGS. 13 and 14, a corner junction assembly indicated generally as 200, may be used to join two adjacent lengths of rail 202, the rail supporting either a venetian blind indicated generally as V or Balloon or Russian drapes indicated generally as D, or any other form of window covering employing controls.

As is well known, venetian blinds employ both tilt-rod mechanisms, and also cord mechanisms for raising and lowering the blind. Such tilt-rods and raising cords will extend around the corner between the two blinds, passing through the corner assembly 200, in the manner described above, in connection with vertical blinds and controls 204 and 206 will hang down from one end of one track.

In the case of Russians and Balloons, where only a single control is provided, usually in the form of a control cord system then the control cords will pass around through the corner assembly, in the manner described above, and such a cord 208 will hang down at one end of one track.

In each case the end result will be that the controls for the two or more blinds are all connected together and will be operated from one end of one of the rails.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A corner junction assembly for use in association with window coverings supported on two adjacent rails, said rails each having at least one movable window covering control means, said corner junction assembly comprising:

upper and lower annular bearing ring means defining respective bearing openings;

respective upper and lower annular bearing hub means rotationally engaged within respective bearing openings in said bearing ring means to permit relative rotation thereof about a common axis;

respective locking rings formed integrally with respective said bearing hub means and making a rotatable captive pressure fit within respective said bearing ring means;

rail engagement means connected to respective ones of said bearing ring means and said bearing hub means for engagement with adjacent ends of respective ones of said rails, and, means attached to said corner junction assembly for facilitating operation of said control means around said corner.

2. A corner junction assembly as claimed in claim 1 and including an opening in one of said upper and lower bearing hub means, and, removable closure means closing said opening.

3. A corner junction assembly as claimed in claim 2, wherein said closure means comprises a locking ring making a captive snap fit within said opening.

4. A corner junction assembly as claimed in claim 2 and wherein said lower bearing ring means is formed separately from said upper bearing ring means and is secured thereto for conjoint rotational movement therewith, and wherein said lower bearing hub means is formed separately from said upper bearing hub means and is secured thereto for conjoint rotational movement therewith.

5. A corner junction assembly as claimed in claim 1 and including a downwardly dependent arcuate cup member formed integrally with said upper bearing hub means, and a bearing surface of corresponding shape, formed on said upper bearing ring means and guidingly engaging the exterior of said cup member.

6. A corner junction assembly as claimed in claim 5 wherein said cup member is formed with a plurality of fracture lines parallel to one another at spaced intervals therearound, whereby portions of said cup member may be broken away during installation of said corner junction assembly with said rails to accommodate different angular positions of said rails.

7. A corner junction assembly as claimed in claim 1 wherein said rail engagement means comprise block members formed on said bearing ring means and said bearing hub means, and adapted to fit into ends of adjacent said rails.

8. A corner junction assembly as claimed in claim 1 and in which said control means comprises at least one length of control cord in each of said rails and at least one pulley for guiding said control cord.

9. A corner junction assembly as claimed in claim 8 wherein said at least one pulley is located externally of said bearing ring means and said bearing hub means.

10. A corner junction assembly as claimed in claim 1 for use with rails in which said control means are rotationally mounted and including movement transmission means adapted to transmit rotational movement between said control means of said two rails.

11. A corner junction assembly as claimed in claim 10, in which said movement transmission means comprises a flexible coupling and which comprises at least one bearing means supporting said flexible coupling.

12. A corner junction assembly as claimed in claim 11 and in which said flexible coupling is adapted to be connected to said control means for conjoint rotation therewith and in such a manner that axial movement of said flexible coupling relative to at least one said control means is possible to accommodate different angular positions of said rails.

13. A corner junction assembly as claimed in claim 10 and in which said movement transmission means comprises interengaged gear means adapted to be secured to ends of said control means of said rails for conjoint rotation therewith.

14. A corner junction assembly as claimed in claim 13 and in which said gear means are adapted to be secured to said ends of said control means for conjoint rotation therewith while permitting axial movement of said gears means relative to at least one of said movement transmission means to accommodate different angular positions of said rails.

15. A corner junction assembly as claimed in claim 14 and in which each at least one said gear means comprises spring means adapted to maintain said gear means in engagement with each other over various angular positions of said rail.

16. A corner junction assembly as claimed in claim 13 and in which said gear means are disposed for rotational movement through a rotational axial position of said corner junction assembly to eliminate the need for relative axial movement of said gear means and said control means during movement of said rails into different angular positions.

17. A corner junction assembly as claimed in claim 10 wherein said rails support travellers and in each of which there are two said rotationally mounted control means, namely first control means for rotating the angular positions of the travellers and second traveller control means for moving the travellers along said rails and in which corner junction assembly there is a first said movement transmission means adapted to transmit rotational movement between said first traveller control means and a second said movement transmission means adapted to transmit rotational movement between said second traveller control means.

18. A corner junction assembly as claimed in claim 17 and in which each of said first and second movement transmission means comprises a flexible coupling supported by a said respective bearing means.

19. A corner junction assembly for use in association with window coverings supported on two adjacent rails, said rails each having first and second movable window covering control means, said corner junction assembly comprising;

at least one annular bearing ring means;

at least one annular bearing hub means rotationally engaged with said bearing ring means to permit relative rotation thereof;

rail engagement means connected to respective ones of said bearing ring means and said bearing hub means for engagement with adjacent ends of respective ones of said rails, and first and second movement transmission means for facilitating operation of said control means around said corner, and in which one of said first and second movement transmission means comprises flexible coupling means supported by a bearing means and in which the other of said first and second movement transmission means comprises interengaged gear means.

20. A corner junction assembly for use in association with two adjacent blind tracks, said tracks each being adapted to carry slat-carrying travellers and each having a rotatably mounted traveller control means, said corner junction assembly comprising:

a first corner member;

a second corner member pivotally connected to said first corner member to permit relative rotation thereof;

track engagement means connected to respective ones of said first and second corner members for engagement with adjacent ends of respective ones of said tracks, and, rotatable transmission means adapted to be coupled to and to transmit rotational movement from a said traveller control means in one said blind track to said traveller control means in the other said blind track said transmission means including interengaged gear means adapted to be secured to ends of said traveller control means of said blind tracks for conjoint rotation therewith.

21. A corner junction assembly as claimed in claim 20, in which said movement transmission means comprises a flexible coupling and which comprises at least one bearing supporting said flexible coupling.

22. A corner junction assembly as claimed in claim 21 for use in association with two adjacent said blind tracks, each comprising first and second rotationally mounted traveller control means, said first traveller control means being provided for moving said travellers along said blind tracks and said second traveller control means being provided for rotating said travellers relative to said blind tracks and which corner junction assembly comprises first and second said flexible couplings adapted to be coupled to and to transmit rotational movement between said first and second traveller control means respectively.

23. A corner junction assembly as claimed in claim 21 and in which said flexible coupling is adapted to be connected to said traveller control means for conjoint rotation therewith but in such a manner that axial movement of said flexible coupling relative to said traveller control means is possible to accommodate different angular positions of said blind tracks.

24. A corner junction assembly as claimed in claim 20 and in which said gear means are adapted to be secured to said ends of said traveller control means for conjoint rotation therewith while permitting axial movement of said gears means relative to at least one of said traveller control means to accommodate different angular positions of said tracks.

25. A corner junction assembly as claimed in claim 20 and in which said gear means are disposed for rotational movement through a rotational axial position of said corner junction assembly to eliminate the need for relative axial movement of said gear means during movement of said blind tracks into different angular positions.

26. A window covering assembly adapted to be installed around at least one corner and comprising:

at least two lengths of rail meeting at said corner adapted to support window coverings;

at least one control means in each said length of track for controlling said window coverings; and a corner junction assembly at said corner, said corner junction assembly in turn comprising:

at least one bearing ring means;

at least one bearing hub means making a captive frictional fit with said bearing ring means to permit relative rotation thereof;

engagement means connected to respective ones of said bearing ring means and said bearing hub means and engaging adjacent ends of respective ones of said lengths of rail at said corner, and, inter-engaged gear means for transmitting movement of at least one of said control means from one said length of rail to the other.

27. A window covering assembly as claimed in claim 26 wherein said window covering assembly is a vertical blind assembly having travellers moving in said rails, and including first and second control means for said travellers.

28. A blind apparatus as claimed in claim 27 wherein said first traveller control means comprises a control cord movable along said tracks to move said slats therealong and in which said first movement transmission means comprises a length of said control cord integrally formed therewith and extending through said corner junction assembly and at least one pulley in said corner junction assembly guiding said control cord.

29. A blind apparatus as claimed in claim 27 wherein at least one of said first and second traveller control means comprises control rods rotatably mounted in said lengths of track and in which a respective one of said first and second movement transmission means is adapted to transmit rotational movement between said control rods.

30. A blind apparatus as claimed in claim 29 and in which said respective one of said first and second movement transmission means comprises a flexible coupling and in which said corner junction assembly comprises at least one bearing means supporting said flexible coupling.

31. A blind apparatus as claimed in claim 30, in which both said first and second traveller control means comprise control rods rotatably mounted in each said length of blind track, in which both said first and second movement transmission means comprise flexible couplings and in which said corner junction assembly comprises at least one bearing supporting a respective said flexible coupling.

32. A blind apparatus as claimed in claim 31 and in which at least one of said flexible couplings is connected to respective ones of said first and second control rods for conjoint rotation therewith but in such a manner that axial movement of said flexible coupling relative to said control rods is possible to accommodate different angular positions of said lengths of blind track.

33. A blind apparatus as claimed in claim 29 and in which said respective one of said first and second movement transmission means comprises interengaged gear means secured to ends of said control rods for conjoint rotation therewith.

34. A blind apparatus as claimed in claim 33 and in which said gear means are secured to said ends of said control rods for conjoint rotation therewith while permitting axial movement of said gear means relative to at least one of said control rods to permit different angular positions of said lengths of blind track.

35. A blind apparatus as claimed in claim 33 and in which said gear means are disposed for rotational movement through a rotational axial position of said corner junction assembly to eliminate the need for relative axial movement of said gear means during movement of said lengths of blind track into different angular positions.

* * * * *